US005601015A

United States Patent [19]

Röttger et al.

[11] Patent Number: 5,601,015

[45] Date of Patent: Feb. 11, 1997

[54] APPARATUS FOR CONTINUOUSLY MAKING A MULTILAYERED, FLAT WORKPIECE

[75] Inventors: Rolf Röttger, Melle; Rudolf Heinrich, Oelde, both of Germany

[73] Assignee: Firma Theodor Hymmen, Bielefeld, Germany

[21] Appl. No.: 325,674

[22] Filed: Oct. 18, 1994

[51] Int. Cl.[6] ..... B30B 5/06

[52] U.S. Cl. ..... 100/93 P; 100/154; 100/269.03; 156/583.3; 156/583.5; 425/371

[58] Field of Search ..... 100/93 P, 93 RP, 100/151, 154, 211, 269.02, 269.03, 269.04; 425/371; 156/583.3, 583.5

[56] References Cited

U.S. PATENT DOCUMENTS

| | | | |
|---|---|---|---|
| 1,870,517 | 8/1932 | Lacey | 100/269.03 |
| 2,142,932 | 1/1939 | Beard | 100/154 |
| 2,411,043 | 11/1946 | Klassen | 100/93 P |
| 2,981,307 | 4/1961 | Malarkey, Jr. | 100/154 |
| 3,680,476 | 8/1972 | Pfeiffer | 100/151 |
| 4,064,299 | 12/1977 | Martin | 100/93 P |
| 4,231,556 | 11/1980 | Heffner et al. | 100/269.03 |
| 4,311,550 | 1/1982 | Kerttula | 100/154 |
| 5,121,683 | 6/1992 | Bielfeldt | 100/154 |
| 5,256,240 | 10/1993 | Shortt | 100/211 |
| 5,303,644 | 4/1994 | Held | 100/154 |
| 5,487,332 | 1/1996 | Handke | 100/93 P |

FOREIGN PATENT DOCUMENTS

| | | | |
|---|---|---|---|
| 1942172 | 3/1971 | Germany | 100/154 |
| 2937972 | 5/1987 | Germany . | |
| 3313406 | 2/1994 | Germany . | |
| 47-24505 | 7/1972 | Japan | 100/269.03 |
| 1579787 | 7/1990 | U.S.S.R. | 100/269.03 |

*Primary Examiner*—Stephen F. Gerrity
*Attorney, Agent, or Firm*—Henry M. Feiereisen

[57] ABSTRACT

Apparatus for continuously making a multilayered, flat workpiece includes a press having with two press belts which are spaced from each other to define a reaction zone for passage of a workpiece in a conveying direction. A pressure element comprised of a pressure plate and a pressure pad defining at least one pressure compartment acts on at least one press belt for exerting pressure onto the workpiece. In order to completely seal the pressure compartment off from the pressure plate and the press belt, the pressure pad is formed by an elastically deformable material such as elastic hoses arranged side-by-side and communicating with each other, or an elastic membrane which extends at a distance to the pressure plate and is tightly secured on its free edge to the pressure plate. Suitably, a slip sheet is disposed between the pressure pad and the press belt.

16 Claims, 8 Drawing Sheets

APPARATUS FOR CONTINUOUSLY MAKING A MULTILAYERED, FLAT WORKPIECE

BACKGROUND OF THE INVENTION

The present invention refers to an apparatus for continuously making a multilayered, flat workpiece, and in particular to an apparatus in which the layer materials for the workpiece are conducted through a reaction zone formed between two press belts, heated there, with pressure being exerted on the layer materials by at least one press belt, and with at least one pressure compartment, which cooperates with a pressure plate situated on the press belt distant side, being associated to this press belt in the reaction zone at the layer-distant side thereof and filled with a gaseous or liquid pressure fluid.

German Pat. No. 33 13 406 describes continuously operating presses with at least one continuous belt which is pressed by a pressure fluid against the workpiece. A pressure fluid is introduced into a rectangular pressure compartment which is situated adjacent the press belt on the side of a pressure plate facing the press belt and is sealed by a circulating sealing strip. The sealing strip is connected with a correspondingly rectangular mounting frame which is guided in a groove of the pressure plate for movement therein and pressurized in direction towards the press belt which slides along this sealing strip.

A drawback of this conventional press is the resulting loss of pressure fluid through the gap between the sealing strip and the circulating press belt in cases of trouble such as uneven wear of the sealing strip, jamming of the mounting frame in the groove of the pressure plate, change of width of the workpiece, or the like, and thus surface defects of the finished product are experienced.

German Pat. No. 29 379 72 discloses an apparatus for applying a surface pressure on advancing workpieces by at least one circulating press belt which is forced onto the workpiece by a pressure fluid contained in pressure compartments arranged successively on the inside of the press belt along the effective pressure surface of the press belt and sealed by respective sealing strips.

This apparatus, too, results in case of trouble during operation in a loss of pressure fluid which escapes through the gap between the sealing strip and the press belt.

SUMMARY OF THE INVENTION

It is an object of the present invention to provide an improved apparatus for continuously making a multilayered, flat workpiece, obviating the afore-stated drawbacks.

It is another object of the invention to provide an improved apparatus for continuously making a multilayered, flat workpiece such that the pressure compartment is not defined directly by the press belt so that the formation of a sealing gap between the circulating press belt and the lateral boundary of the pressure compartment is eliminated.

These objects, and others which will become apparent hereinafter, are attained in accordance with the present invention by partly or completely enclosing the pressure compartment or pressure compartments and sealing the latter off in a gas-tight or liquid-tight manner from the pressure plate and one continuous press belt by means of an elastically deformable member, and by disposing a slip sheet between the pressure compartment or pressure compartments and the circulating press belt.

In accordance with a preferred embodiment, the pressure compartments are formed by neighboring elastic hoses which are filled with a pressure fluid and communicate with each other via distribution passages extending at the axial ends of the hoses.

The pressure compartment may however also be defined at the side facing the press belt by an elastic membrane which is secured on its free edge in an air-tight manner to the pressure plate.

By designing the pressure compartment or pressure compartments in form of a leakproof pressure pad which is filled with pressure fluid, the apparatus is suitable for use with differently sized workpieces, without adversely effecting the tightness of the pressure pad.

The slip sheet between the pressure pad and the pressure belt may be secured to the pressure plate at the front axial end face or may be secured to both axial ends faces of the pressure plate. It is also possible to draw the slip sheet off respective rollers arranged before and behind the pressure plate. Since the slip sheet represents a wearing part, it is preferred to form the slip sheet as a separate component in order to simplify a replacement thereof.

Heat generated through friction between the slip sheet and the continuously circulating press belt can be used as process heat. Moreover, the apparatus runs quietly and is easy to maintain.

According to another feature of the present invention, it also feasible to line the outer surface of the elastic hoses of the pressure pad with a slip coating.

Preferably, the pressure pad and the pressure plate are united to form a structural unit so that the double belt press can be equipped with a plurality of separate such structural units along the reaction zone. In this manner, defective units can be replaced without adversely affecting the overall process. Suitably, the pressure plate may be provided with horizontal guide tracks which extend transversely to the conveying direction of the workpiece and are slidingly supported on stationary guide tracks.

According to another embodiment of the present invention, the pressure plate is mounted in a pressure frame, with a further pressure pad in form of neighboring elastic hoses being arranged between the pressure plate and the pressure frame. In a similar manner as the pressure pad between the pressure plate and the slip sheet, the hoses of the further pressure pad communicate with each other via distribution passages for flow of pressure fluid therethrough. Preferably, the pressure in the hoses between the pressure plate and the pressure frame exceeds the pressure in the pressure pad between the pressure plate and the press belt.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
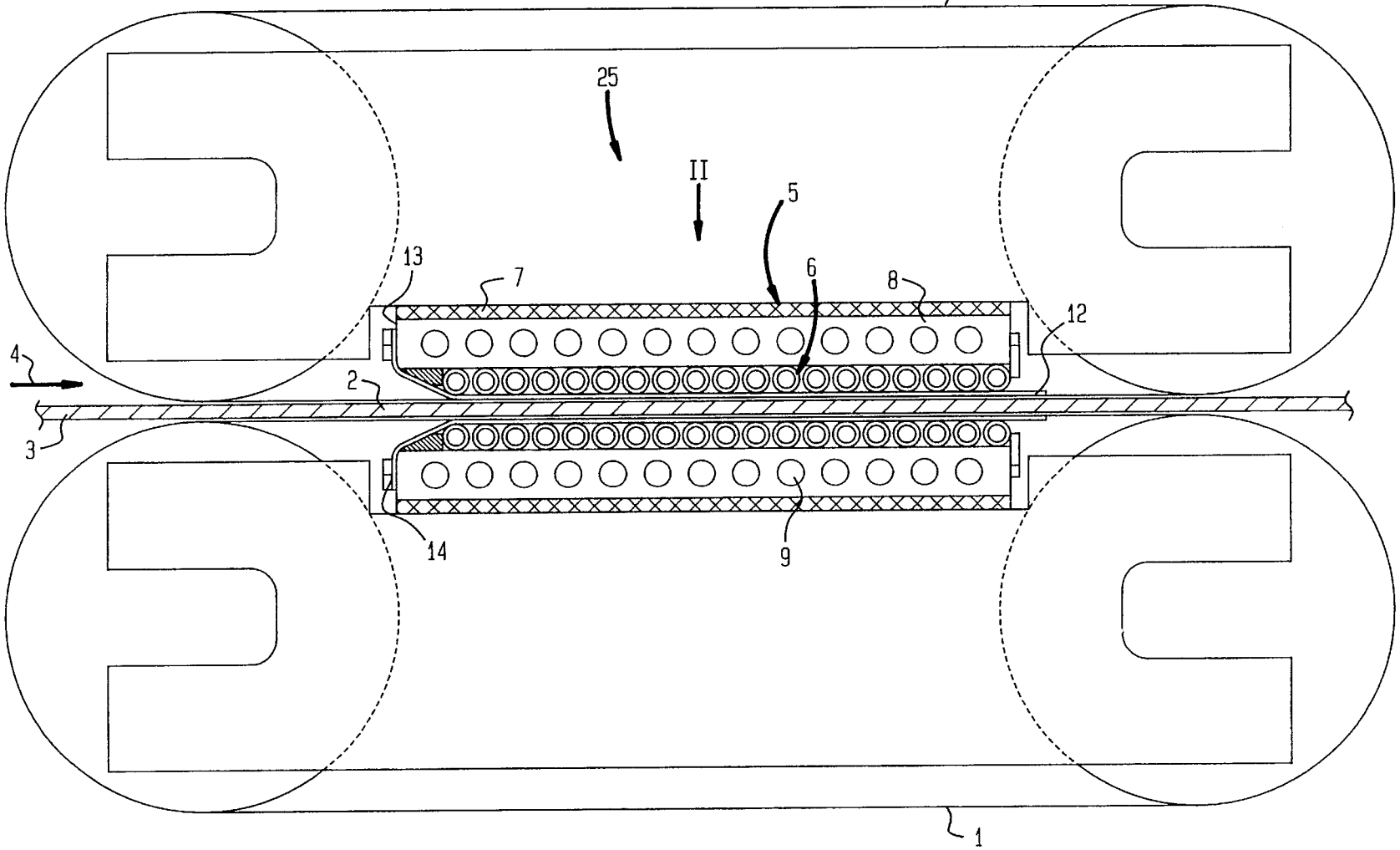
FIG. 1 is a schematic side view of one embodiment of a double belt press according to the present invention, with a fluid-tight pressure pad acting upon each press belt in the reaction zone.

Throughout all the Figures, the same or corresponding elements are generally indicated by the same reference numerals.

Turning now to the drawing, and in particular to FIG. 1, there is shown a schematic side view of one embodiment of an apparatus for making multilayered, flat workpieces in form of a double belt press with two continuously circulating press belts 1 which are spaced from each other along their downstream strands to form a compression gap for passage by a workpiece 3 in a conveying direction indicated by arrow 4. Adjoining each press belt 1 at the workpiece-distant side is a pressure arrangement, comprised of a pressure plate 5 and a pressure pad 6 to define a reaction zone 2 for treatment of the advancing workpiece 3.

The pressure plate 5 includes an outer insulating board 7 and a heating board 8 which adjoins the insulating board 7 and accommodates heating pipes or a heating coil 9 for allowing a heating and cooling of the workpiece 3 in the reaction zone 2.

In the embodiment of the double belt press of FIG. 1, the pressure pad 6 is formed by hoses 10 which have an intrinsic elasticity. The hoses 10 are positioned in a side-by-side relation transversely to the press belts 1 and parallel to each other, and are filled with a pressure fluid which may be of gaseous, liquid or hydropneumatic properties. Persons skilled in the art will understand that the pressure fluid in the hoses 10 may also be utilized in addition to the fluid within the heating coil 9, or exclusively, to heat and cool the workpiece 3 in the reaction zone 2.

Figure 2:
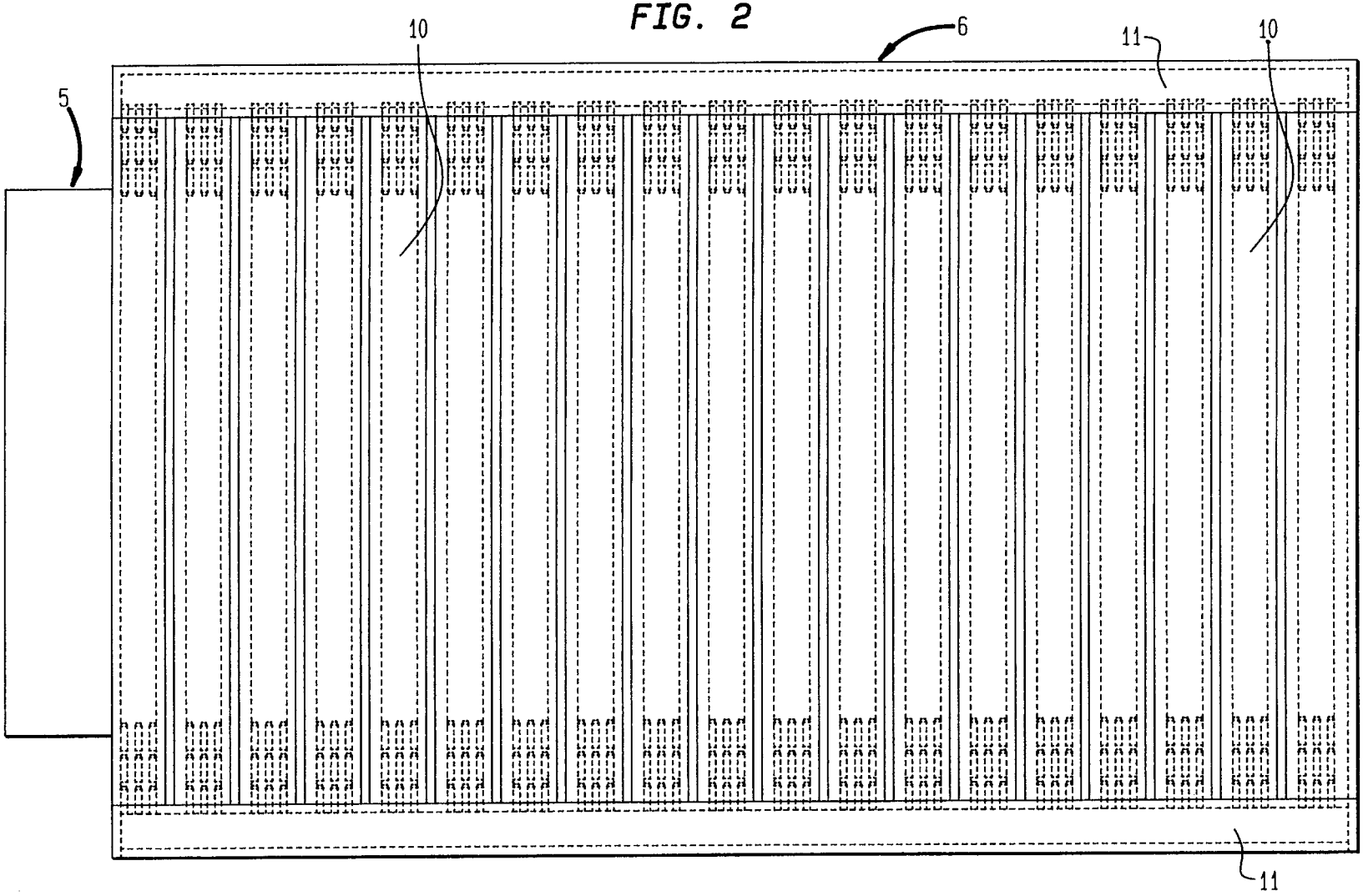
FIG. 2 is a plan view of the pressure pad in direction of the arrow II in FIG. 1.

FIG. 2 shows a plan view of the pressure pad 6 in direction of the arrow II in FIG. 1, and it can be seen that the axial ends of the hoses 10 communicate with each other via opposite distribution passages 11 which may be made of metallic parts and are positioned outside the boundary of the pressure plate 5. Thus, pressure fluid is introduced into one of these distribution passages 11 for supply to the hoses 10 in which the pressure fluid may stand or circulate.

Figure 3:
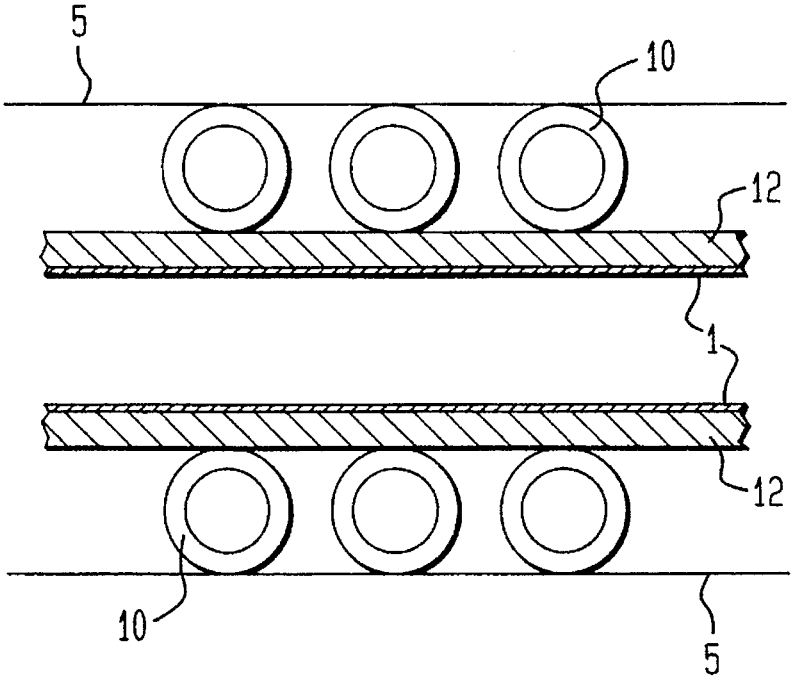
FIG. 3 is a fragmentary, partially sectional view of the reaction zone of the double belt press at idle operation.

As further shown in FIG. 1, and in particular in FIG. 3, a slip sheet 12 is disposed in the reaction zone 2 between the pressure pad 6 and the circulating press belt 1. The slip sheet 12 may be made of polytetrafluoroethylene or any other suitable material and is secured to pressure plate 5 on the forward end face 13 thereof which extends across to the press belt 1. Suitably, the attachment of the slip sheet 12 is executed via screw fasteners 14 so that the slip sheet 12, which forms a wearing part, can easily be replaced. The other end of the slip sheet 12 rests freely upon the downstream or working strand of the press belt 1.

FIG. 3 shows the double belt press in idle operation, with no workpiece 3 passing through the reaction zone 2. In this stage, the inside of the hoses 10 is filled with pressure fluid, but no deformation of the hoses 10 is encountered which thus define the compression gap for the workpiece 3.

Figure 4:
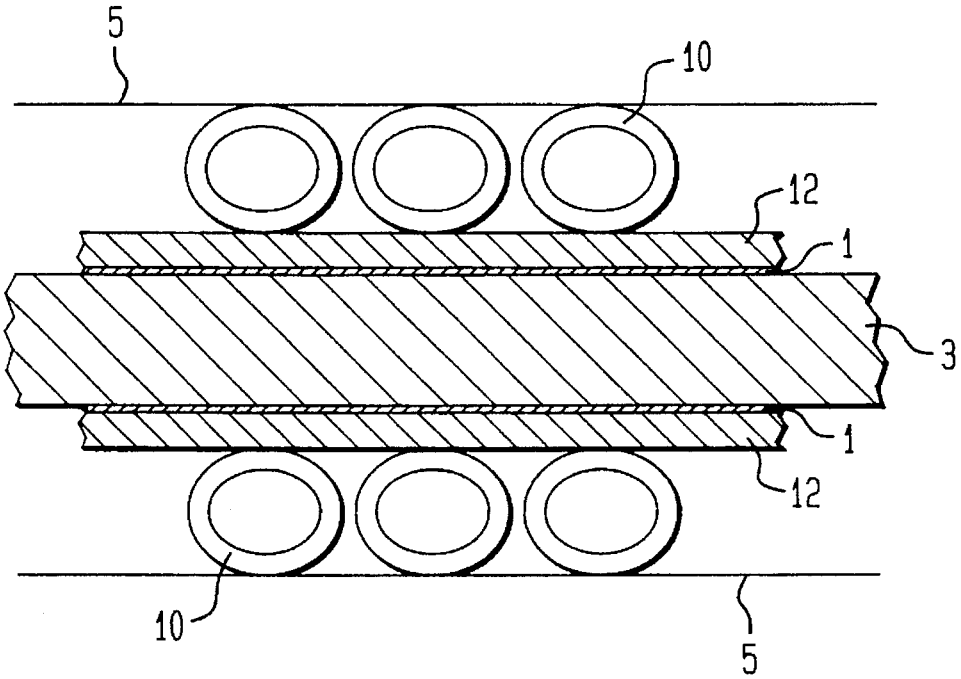
FIG. 4 is a fragmentary partially sectional view of the reaction zone of the double belt press of FIG. 3 upon passage of a workpiece.

FIG. 4 shows the double belt press at operation, with a workpiece 3 advancing through the reaction zone 2. During its advance, the width of the workpiece 3 causes an elliptic deformation of the elastic hoses 10. Thus, workpieces of different sizes can be guided through the reaction zone 2, without experiencing leakage or escape of pressure fluid into the atmosphere in the area of the pressure pad 6.

Figure 4A:
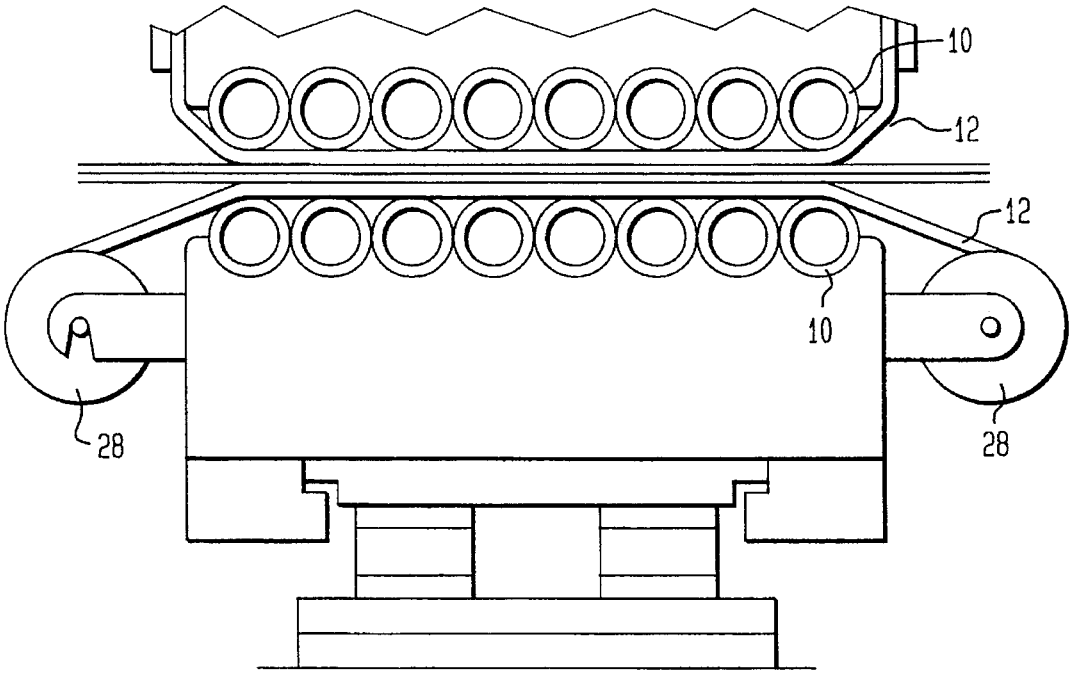
FIG. 4*a* is a fragmentary side view of the reaction zone of a modified double belt press illustrating a reel-off mechanism for a slip element.
Figure 4B:
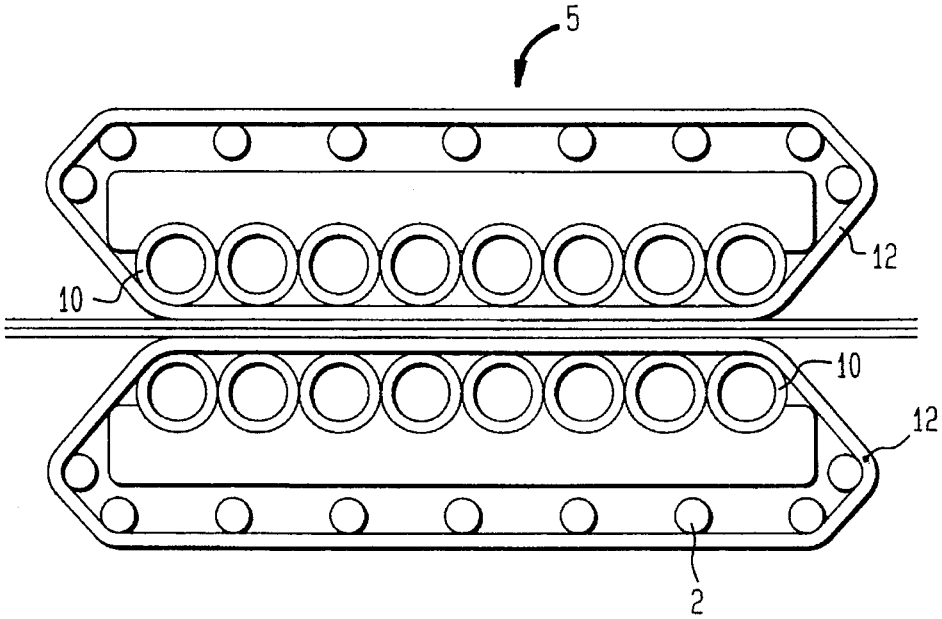
FIG. 4*b* is a fragmentary side view of the reaction zone of a modified double belt press, illustrating a continuous circulation of a slip element.

As shown in FIG. 4*a*, the slip sheet 12 may be drawn off and reeled by rollers 28 which are respectively arranged in the conveying direction before and behind the pressure plate 5. The slip sheet 12 may also be formed as an endless band which circulates the pressure plate 5 as shown in FIG. 4*b*.

As an alternative to the provision of a separate slip sheet, it is also possible to simply line the outside surface of the hoses 10 with a slip coating.

Figure 5:
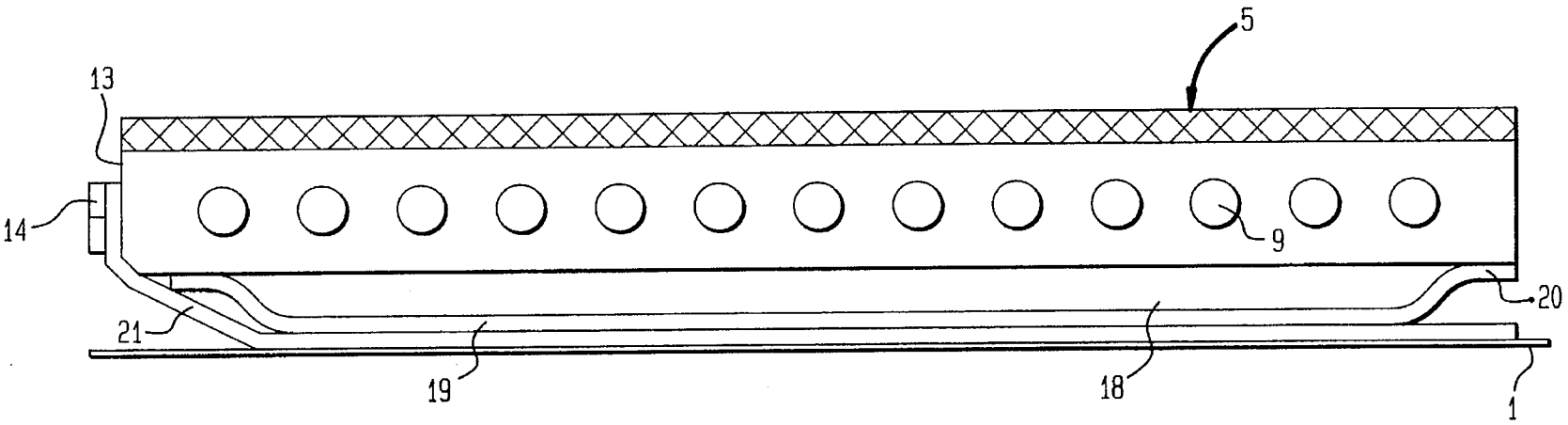
FIG. 5 is a longitudinal section of a modified pressure pad of the present invention.

While the pressure pad 6 according to the embodiment shown in FIG. 1 is formed by elastic hoses 10 which extend across the press belts 1 and thus transversely to the conveying direction of the workpiece 3, FIG. 5 shows a longitudinal section of a modified pressure pad which has a pressure compartment 18 formed between the pressure plate 5 and an elastic membrane 19 which is suitably spaced from the opposite end side of the pressure plate 5 and is tightly secured with its free edge 20 to the pressure plate 5. Pressure fluid is introduced into the pressure compartment via the pressure plate 5 to build up the desired working pressure in the pressure compartment 18.

In the nonlimiting example of FIG. 5, the double belt press is also provided with a slip sheet 21 which is disposed between the membrane 19 and the press belt 1. The slip sheet 21 is detachably secured to the end face 13 of the pressure plate 5 by screw fasteners 14. It will be appreciated by persons skilled in the art, that the slip sheet may also form the outer coating of the membrane or may form an inner lining of the press belt which cooperates with the pressure compartment 18.

Figure 6:
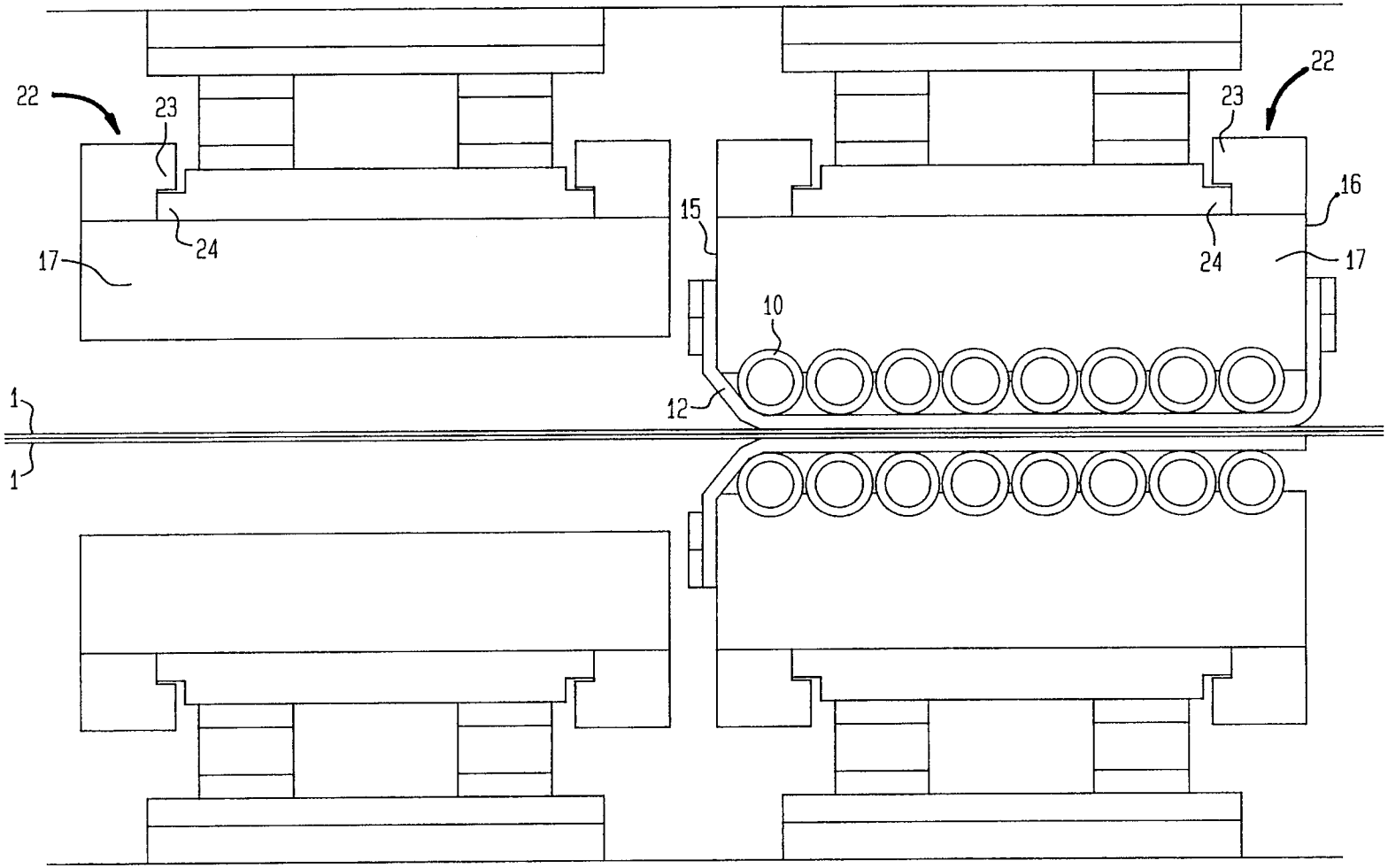
FIG. 6 is a schematic side view of another embodiment of a double belt press according to the present invention, including several, exchangeable structural units, each provided with a sealed pressure pad.

Turning now to FIG. 6, there is shown a schematic side view of another embodiment of a double belt press according to the present invention, which includes in the reaction zone 2 a plurality of structural units, generally designated by reference numeral 22 and successively arranged in conveying direction along the workpiece distant side of the press belts 1, with each structural unit 22 including a pressure pad 6 and a pressure plate 17. The pressure plate 17 is provided sideways with upwardly projecting horizontal guide tracks 23 which extend transversely to the press belt 1 and are slidably supported and secured to stationary guide tracks 24. Each structural unit 22 can thus be individually removed and replaced in case of defect or malfunction 22. The provision of several, separate and independent structural units 22 therefore enables a continuous operation without interruption when one structural unit 22 is to be replaced.

Each structural unit 22 is provided with a slip sheet 12 which extends between the pressure pad 6 and the press belt 1 and is detachably secured to both end faces 15, 16 of the pressure plate 17.

At operation, the pressure range of the working pressure in the sealed pressure pad 6 can reach up to 20 bar, and the temperature range can reach up to 250° C.

Figure 8:
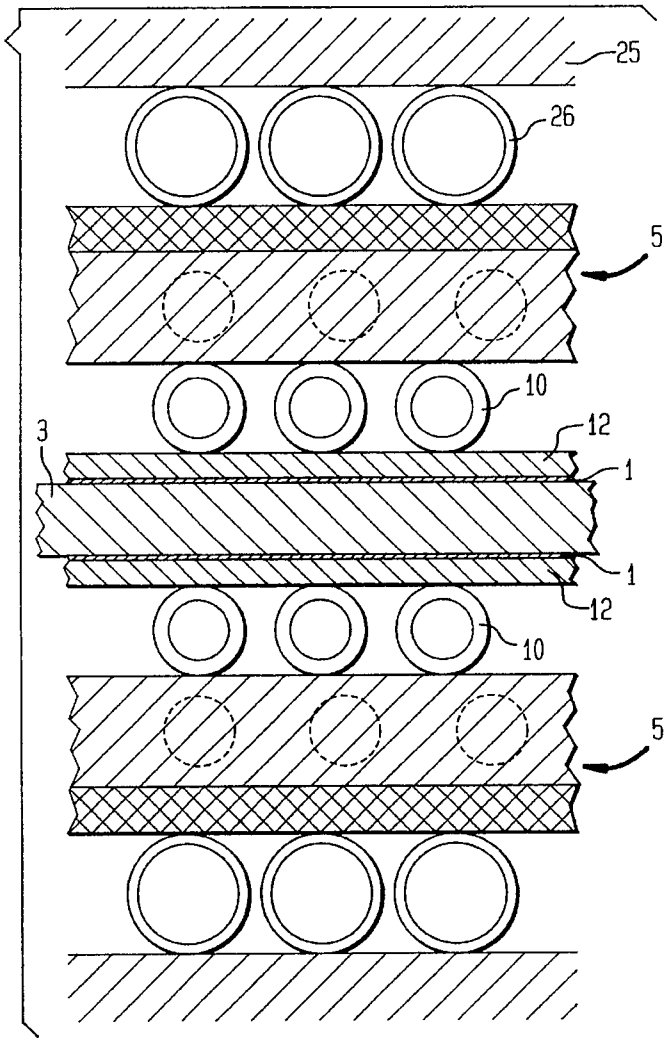
FIG. 8 is a fragmentary, partially sectional view of the double belt press according to FIG. 7 during passage of a workpiece through the reaction zone.
Figure 7:
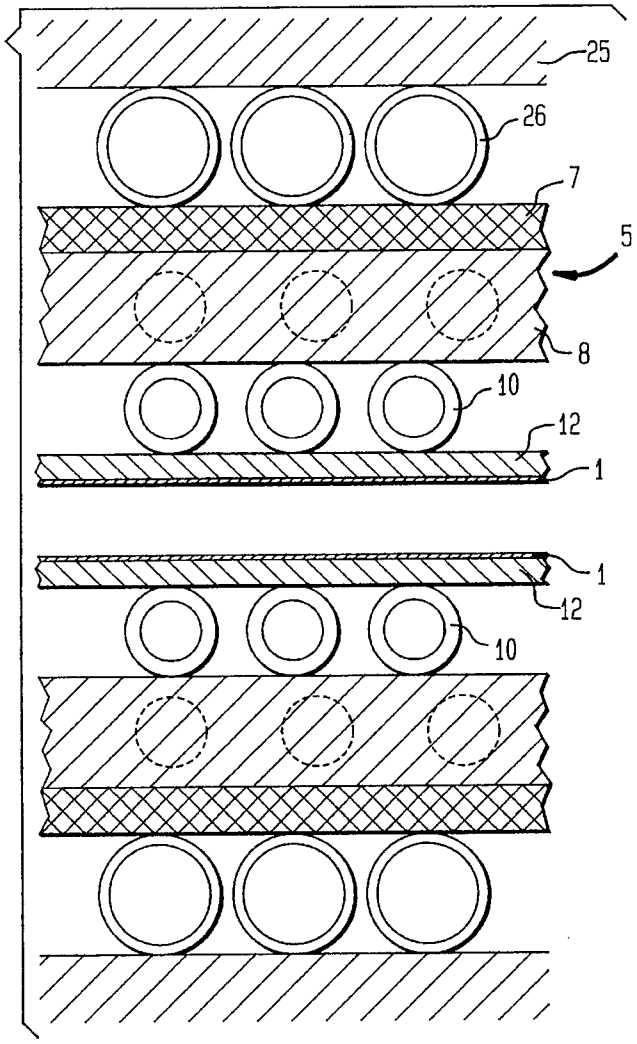
FIG. 7 is a fragmentary, partially sectional view of yet another embodiment of a double belt press in idle operation, with an additional pressure pad being provided between the pressure plate and a pressure frame in the reaction zone.

Referring now to FIGS. 7 and 8, there are shown fragmentary, partially sectional views of yet another embodiment of a double belt press according to the present invention, with FIG. 7 illustrating the reaction zone at idle operation and FIG. 8 showing the reaction zone during passage of the workpiece 3. The pressure plate 5 is integrated in a pressure frame 25, with hoses 26 being arranged between the pressure plate 5 and the pressure frame 25 to form a further pressure pad. Suitably, the pressure within the hoses 26 exceeds the pressure in the hoses 10 of the pressure pad 6 placed between the pressure plate 5 and the press belt 1. The pressurized hoses 26 form between the pressure plate 5 and the pressure frame 25 an elastic abutment which also serves as additional heat insulation and compensates flexures of the pressure frame 25.

The elastic hoses 26 which are filled with pressure fluid extend, like the hoses 10, transversely to the conveying direction 4 of the workpieces 3 and communicate with each other at their axial ends via distribution passages for the pressure fluid.

Figure 9:
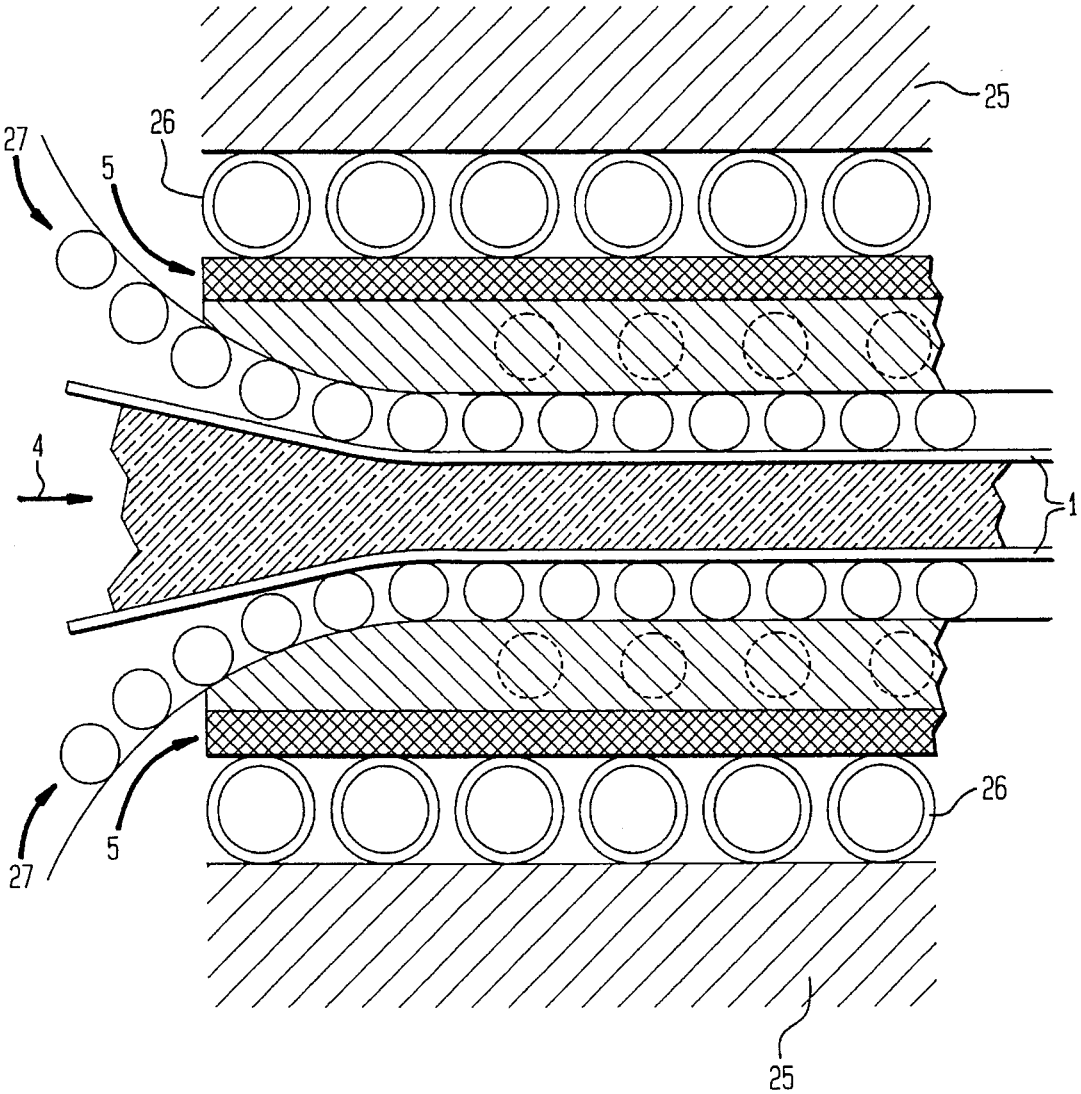
FIG. 9 is a fragmentary, partially sectional view of still another embodiment of a double belt press according to the present invention, with a roller train disposed between the pressure plate and the press belt.

FIG. 9 illustrates a fragmentary, partially sectional view of still another embodiment of a double belt press according to the present invention, in which the slip sheet is substituted by a continuous roller train 27 located between the pressure plate 5 and the press belt 1. Only one pressure pad is arranged between the pressure plate 5 and the pressure frame 25 and formed of neighboring, elastic hoses 26 which contain a pressure fluid and are connected to each other at their axial ends via respective distribution passages for the pressure fluid.

While the invention has been illustrated and described as embodied in an apparatus for continuously making a multilayered, flat workpiece, it is not intended to be limited to the details shown since various modifications and structural changes may be made without departing in any way from the spirit of the present invention.

What is claimed as new and desired to be protected by Letters Patent is set forth in the appended claims:

1. Apparatus for continuously making multilayered flat workpieces; comprising:

two press belts spaced from each other to, define a reaction zone for passage of a workpiece in a conveying direction; and pressure applicator means acting on at least one of said press belts for applying pressure onto the workpiece, said pressure application means including a pressure plate and an elastically deformable pressure pad cooperating with said pressure plate and provided in the form of a plurality of neighboring hoses, each having a first and a second end and containing pressure fluid to define a pressure compartment in the reaction zone at the workpiece-distant side of said press bolt, said hoses extending transversely to the conveying direction of the workpiece and being connected to each other at their first ends by a first distribution passage and at their second ends by a second distribution passage with the first and second distribution passages being located outside the pressure plate which viewed in plan view.

2. Apparatus as defined in claim 1, and further comprising a slip element disposed between said pressure pad and said press belt.

3. Apparatus as defined in claim 2 wherein said slip element is a slip sheet secured to said pressure plate at a forward axial end face thereof which extends transversely to the conveying direction.

4. Apparatus as defined in claim 2 wherein said slip element is a slip sheet secured to both axial end faces of said pressure plate.

5. Apparatus as defined in claim 2, further comprising rollers for allowing winding and unwinding of said slip element, said, rollers being respectively arranged in the conveying direction before and behind said pressure plate.

6. Apparatus as defined in claim 2 wherein said slip element is a slip sheet in the form of a continuous band which circulates said pressure plate.

7. Apparatus as defined in claim 2 wherein one of said press belts is an endless press belt which cooperates with the pressure compartment, said slip element being a slip sheet formed as an inside liner of said endless press belt.

8. Apparatus as defined in claim 1 wherein said hoses have an outer surface which is lined with a slip coating.

9. Apparatus as defined in claim 1 wherein said pressure pad and said pressure plate form a structural unit, with said pressure pad being sealed off from said pressure plate, and further comprising a plurality of separate such structural units arranged in the reaction zone for allowing individual replacement thereof.

10. Apparatus as defined in claim 9 wherein said pressure plate is provided with horizontal guide tracks extending transversely to the conveying direction and slidingly supported on stationary guide tracks.

11. Apparatus as defined in claim 1, further comprising a pressure frame for supporting said pressure plate, and a second set of elastic hoses arranged side-by-side between said pressure plate and said pressure frame and containing a pressure fluid, said second set of hoses being connected with each at their ends via distribution passages.

12. Apparatus as defined in claim 11 wherein said second set of hoses extends transversely to the conveying direction of the workpiece.

13. Apparatus as defined in claim 11 wherein said second set of hoses is subjected to a pressure which exceeds a pressure in said pressure pad arranged between said pressure plate and said press belt.

14. Apparatus as defined in claim 11 wherein said pressure pad extends between said pressure plate and said pressure frame, and further comprising a circulating roller train arranged between said pressure plate and said press belt.

15. Apparatus as defined in claim 1 wherein said pressure pad is tightly sealed off from said pressure plate and said press belts.

16. Apparatus for continuously making multilayered flat workpiece comprising:

two press belts spaced from each other to define a reaction zone for passage of a workplace in a conveying direction;

pressure application means acting on at least one of said press belts for applying pressure onto the workplace, said pressure application means including a plurality of neighboring elastically deformable hoses for accommodating a pressure fluid and defining a pressure compartment in the reaction zone at the workpiece-distant side of said press belt, each of said hoses extending across the conveying direction of the workpiece and having a first a second end, the first ends and the second ends of said plurality of hoses, respectively connected to each other outside a pressure application zone; and a slip element disposed between said pressure application means and said press belt.

* * * * *